US008052805B2

(12) United States Patent
Hendrickson et al.

(10) Patent No.: US 8,052,805 B2
(45) Date of Patent: Nov. 8, 2011

(54) METHOD FOR AUTOMATICALLY FLUSHING A BULK DISPENSING SYSTEM IN A CLEANING APPLIANCE

(75) Inventors: Michael Stephen Hendrickson, Saint Joseph, MI (US); Michael T. Dalton, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 386 days.

(21) Appl. No.: 12/165,819

(22) Filed: Jul. 1, 2008

(65) Prior Publication Data

US 2010/0000578 A1 Jan. 7, 2010

(51) Int. Cl.
*B08B 3/00* (2006.01)

(52) U.S. Cl. ..... 134/57 R; 134/58 R

(58) Field of Classification Search ..... 134/57 R, 134/58 R

See application file for complete search history.

(56) References Cited

U.S. PATENT DOCUMENTS

| | | | | |
|---|---|---|---|---|
| 3,120,329 | A | 2/1964 | Noakes | |
| 3,736,773 | A | 6/1973 | Waugh | |
| 3,848,436 | A | 11/1974 | Rottering | |
| 3,848,437 | A | 11/1974 | Rottering | |
| 4,009,598 | A | 3/1977 | Bernard et al. | |
| 4,569,781 | A * | 2/1986 | Fernholz et al. | 510/225 |
| 4,845,965 | A | 7/1989 | Copeland et al. | |
| 5,014,211 | A | 5/1991 | Turner et al. | |
| 2002/0040506 | A1 * | 4/2002 | Seagar et al. | 8/159 |
| 2003/0051513 | A1 * | 3/2003 | Castelli et al. | 68/12.18 |
| 2004/0244434 | A1 * | 12/2004 | Zucholl et al. | 68/12.16 |
| 2007/0022790 | A1 * | 2/2007 | Slutsky et al. | 68/208 |
| 2007/0261177 | A1 * | 11/2007 | Risen et al. | 8/158 |

FOREIGN PATENT DOCUMENTS

EP 1731654 12/2007

* cited by examiner

*Primary Examiner* — Michael Barr
*Assistant Examiner* — Charles W Kling
(74) *Attorney, Agent, or Firm* — Clifton G. Green; McGarry Bair PC

(57) ABSTRACT

A method for flushing at least a portion of a bulk dispensing system in a household cleaning appliance.

8 Claims, 5 Drawing Sheets

METHOD FOR AUTOMATICALLY FLUSHING A BULK DISPENSING SYSTEM IN A CLEANING APPLIANCE

BACKGROUND OF THE INVENTION

Cleaning appliances, such as dishwashers or clothes washers, use multiple treating chemistries and combinations of treating chemistries to achieve better cleaning. Before choosing a treating chemistry, a user may take into account the type and quantity of the items being cleaned along with the type and quantity of soils and stains on the items. There are many different types of treating chemistries, e.g. detergents, bleach, enzymes, anti-spotting agents, aroma agents, etc. Some of these treating chemistries are deleterious to another chemistry's efficacy. An example is bleach, which is known to destroy certain enzymes found in detergents. Therefore, it may be desirable to control the dispensing of the treating chemistries in such a way as to avoid these negative consequences.

This problem is exacerbated in bulk dispensing systems, which often use multiple refillable or replaceable containers, with each container coupled by its own supply line directly to the treatment chamber or to a common header that supplies the treatment chamber. Residual treating chemistry often remains in the supply line. If a consumer refills a container with a new chemistry that may be incompatible with the prior chemistry, the supplying of the new chemistry through the residual chemistry may reduce the efficacy of the new chemistry and negatively impact the cleaning performance of the appliance.

SUMMARY OF THE INVENTION

The invention relates to a method for flushing a bulk dispensing system in a household cleaning appliance.

DESCRIPTION OF EMBODIMENTS OF THE INVENTION

Figure 1:
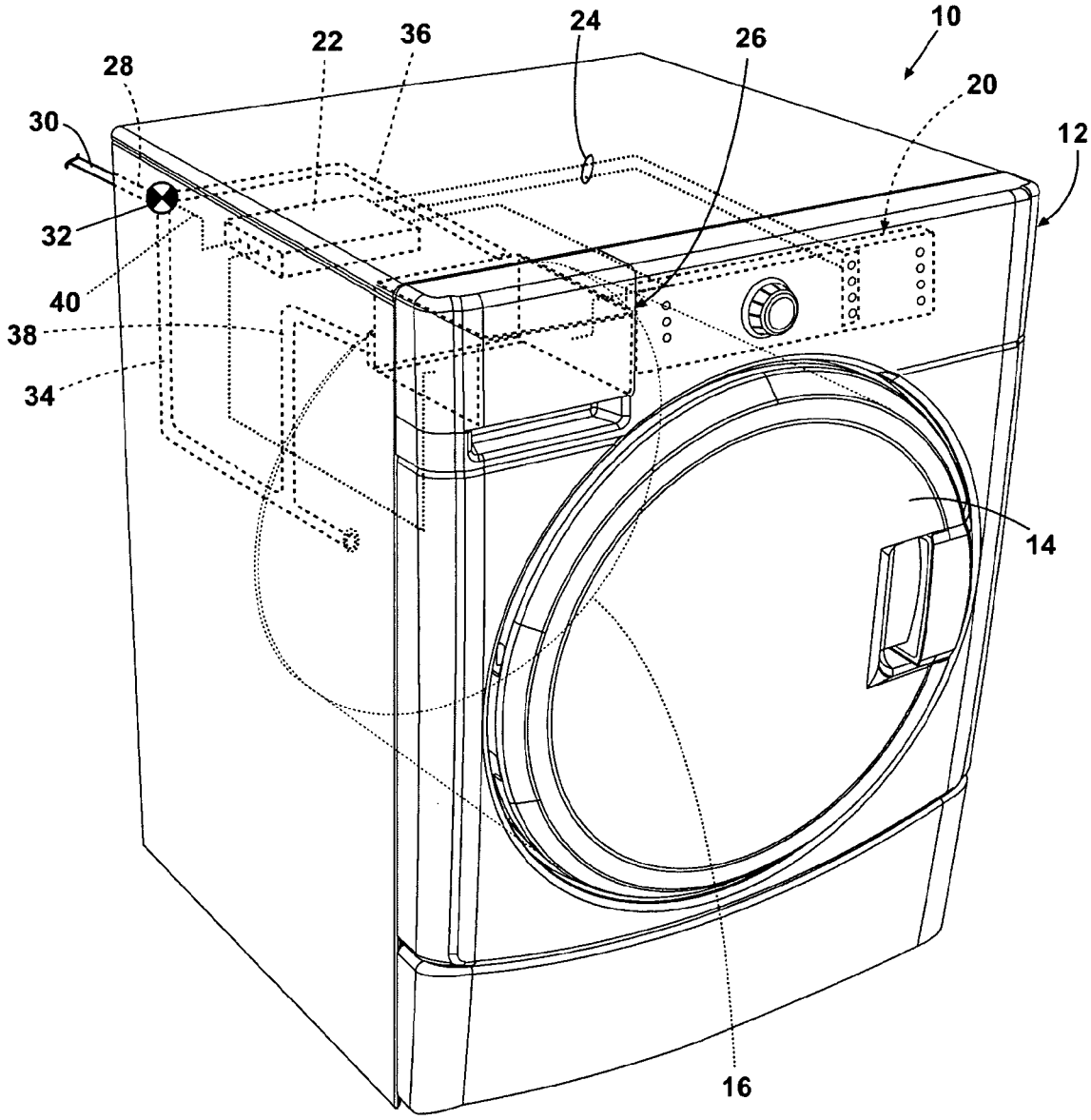
FIG. 1 is a perspective view of an automatic clothes washing machine having a bulk dispensing system according to one embodiment of the invention.

Referring now to FIG. 1, a first embodiment of the invention may be illustrated as a cleaning appliance in the environment of a horizontal axis automatic clothes washing machine 10. Although much of the remainder of this application will focus on the embodiment of an automatic clothes washing machine, the invention may have utility in other environments, including other cleaning appliances, such as dishwashers, for example. The automatic clothes washing machine 10 shares many features of a conventional automated clothes washer, which will not be described in detail herein except as necessary for a complete understanding of the invention.

Further, washing machines are typically categorized as either a vertical axis washing machine or a horizontal axis washing machine. The invention disclosed herein may be suitable for use in both horizontal axis and vertical axis automatic clothes washing machines. The invention will be illustrated and described, however, in the context of a horizontal axis washing machine.

The automatic clothes washing machine 10 may include a cabinet 12 enclosing components found in a conventional washing machine, such as motors, pumps, fluid lines, controls, sensors, transducers, and the like. A door 14 may be mounted to the cabinet to selectively close an access opening to the interior of a tub 16 that defines a treating chamber in which laundry is treated. The tub 16 may be associated with a sump 18 (FIG. 2) for carrying a liquid used during a wash cycle. The cabinet 12 may include a user interface 20 that may have operational controls such as dials, lights, switches, and displays enabling a user to input commands to a controller 22 and receive information about a specific wash cycle. The user interface 20 may be electrically coupled with the controller 22 through user interface lead 24.

The cabinet 12 may also include a bulk dispensing system 26 for dispensing treating chemistry during a wash cycle. In this embodiment the treating chemistry may be any type of aid for treating fabric, and examples may include, but are not limited to washing aids, such as detergents and oxidizers, including bleaches, and additives, such as fabric softeners, sanitizers, de-wrinklers, and chemicals for imparting desired properties to the fabric, including stain resistance, fragrance (e.g., perfumes), insect repellency, and UV protection.

The cabinet 12 may further include a conduit 28 fluidly coupled with a water supply 30 to couple the automatic clothes washing machine 10 to the water supply 30. A valve 32 couples the conduit 28 with a dispensing line 34, which leads to the tub 16, and a dispensing line 36, which leads to the bulk dispensing system 26. Thus, the valve 32 may be used to control the introduction of fresh water from the water supply 30 into the tub 16, or the bulk dispensing system 26. A dispensing line 38 fluidly couples the bulk dispensing system 26 with the tub 16. Thus, fresh water may be delivered from the water supply 30 through the conduit 28, valve 32 and dispensing line 36 into the bulk dispensing system 26 for flushing treating chemistry from the bulk dispensing system 26 through the dispensing line 38 into the tub 16. The valve 32 may be electrically coupled with the controller 22 through a valve control lead 40. The controller 22 may control the operation of the valve 32 in response to the cycle and options selected by the user through the user interface 20.

Alternately, the bulk dispensing system 26 and the water from the water supply could be discharged into the dispensing line 38 or the tub 16 by a pump (not shown). The pump may be operably coupled to the controller 22 such that the controller 22 may control the dispensing of the treating chemistry and water by the actuation of the pump. Thus, the pump may deliver the treating chemistry and water mixture to the dispensing line 38 or the tub 16 under pressure.

Figure 2:
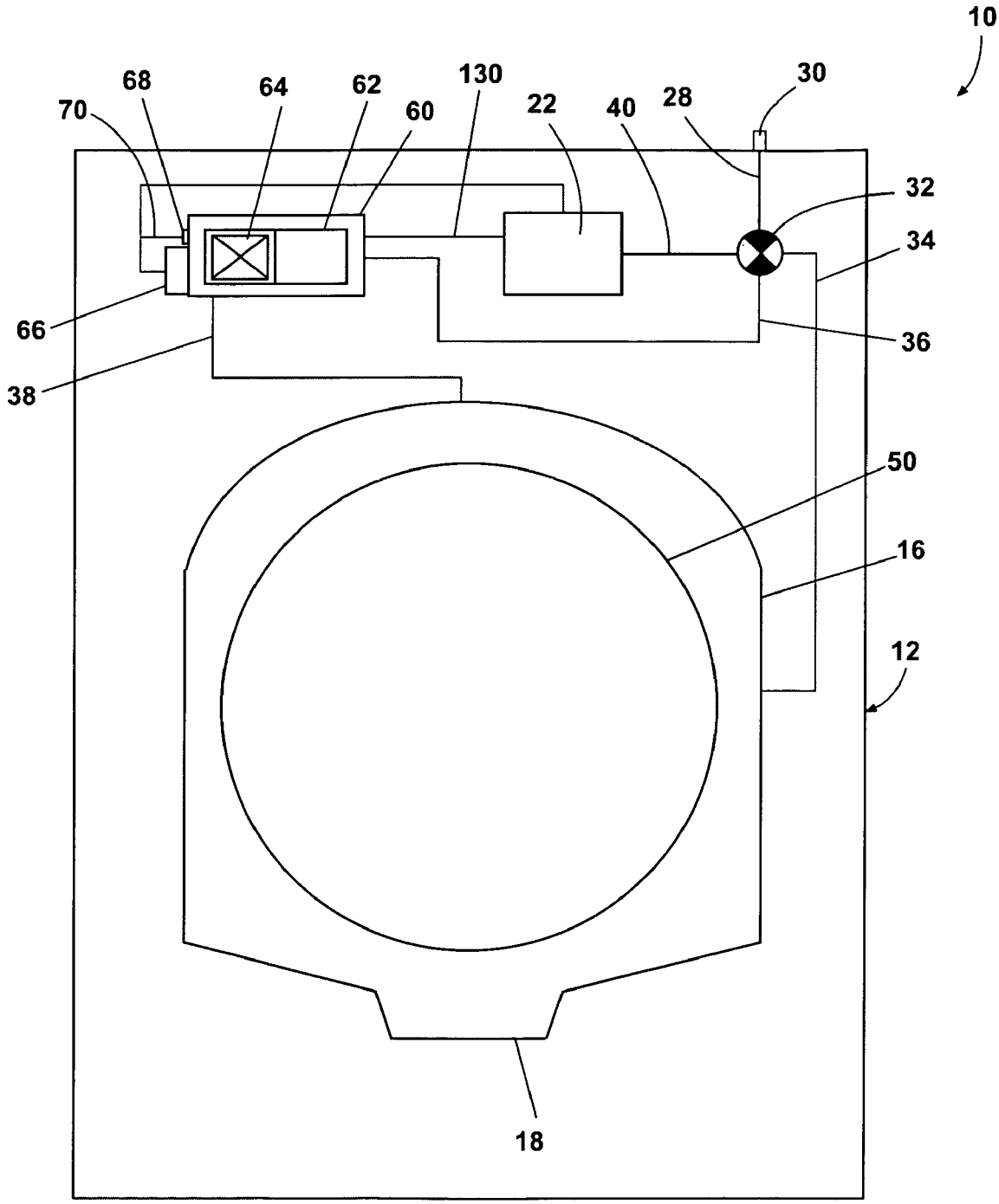
FIG. 2 is a schematic view of the automatic clothes washing machine illustrated in FIG. 1 with a first exemplary bulk dispensing system according to one embodiment of the invention.

FIG. 2 schematically illustrates various aspects of the automatic clothes washing machine 10 according to one embodiment of the invention. From FIG. 2 it may be seen that both the tub 16 and a drum 50 are suspended in the interior of the cabinet 12. The bulk dispensing system includes a dispenser housing 60 and a dispenser drawer 62 slideably received within and fluidly coupled to the dispenser housing 60. The bulk dispensing system may also include a bulk dispenser cartridge 64 that may be inserted in the dispenser drawer 62 and a dispenser pump 66 fluidly coupled to the bulk dispenser cartridge and a conduit that may be formed by the dispenser housing 60 and the dispensing line 38 which in turn fluidly couples the tub 16. Thus, the bulk dispenser cartridge 64 is fluidly coupled to the dispenser housing 60 through the dispenser pump 66. Alternatively, the dispenser pump 66 may be a mechanical flow meter, a magnetic flow meter, or any other meter suitable for measuring liquid flow, all well known in the cleaning appliance art.

In general, the bulk dispensing system may be a drawer-type, single-use dispensing system having multiple dispenser cups with bulk dispensing functionality added to the single-use dispensing system by the addition of a bulk dispensing cartridge and a metering device. In other embodiments the bulk dispensing system may be fixed within the cabinet 12 (not shown) and have a moveable door, hatch, access panel, or other access mechanism for access to it.

FIG. 2 also illustrates the cabinet 12 enclosing a treating chemistry sensor 68, for sensing the amount of treating chemistry in the bulk dispenser cartridge 64. The treating chemistry sensor 68 may be electrically coupled with the controller 22 through a dispenser sensor lead 70. The treating chemistry sensor 68 may be a resistivity sensor having a pair of electrodes in contact with the treating chemistry and capable of generating a signal proportional to the depth of the treating chemistry in the bulk dispenser cartridge 64. The treating chemistry sensor 68 may also be a refractive index sensor containing a transmitter and the treating chemistry sensor 68 whereby a beam of light may be projected onto the treating chemistry surface from the transmitter back to the treating chemistry sensor 68, which generates a signal consistent with either the chemistry or air to determine if the treating chemistry is present in the bulk dispenser cartridge 64. The treating chemistry sensor 68 may also be a height transducer capable of generating a signal proportional to the height (and thus the volume) of the treating chemistry in the bulk dispenser cartridge 64. Alternatively, the treating chemistry sensor may be a float or reed switch that may switch on or off when the fluid reaches a certain level.

Regardless of the type of treating chemistry sensor 68 the signal output from the treating chemistry sensor 68 may be delivered to the controller 22 through the dispenser sensor lead 70. The foregoing descriptions are of an exemplary sensor location. Other locations may be utilized for a treating chemistry sensor 68, for example, incorporated into the dispenser pump 66, incorporated into the dispensing line 38, or incorporated into a part of the dispenser drawer 62.

The automatic clothes washing machine 10 illustrated in FIGS. 1 and 2 is only one example of a washing machine configuration. It will be recognized that a fewer or greater number of conduits as well as pumps may be utilized for selected functions, a fewer or greater number of valves may be utilized depending upon the selected fluid line configuration and degree of control desired, and control leads may be incorporated into the device based upon the components for which control by the controller 22 may be desired.

Figure 3:
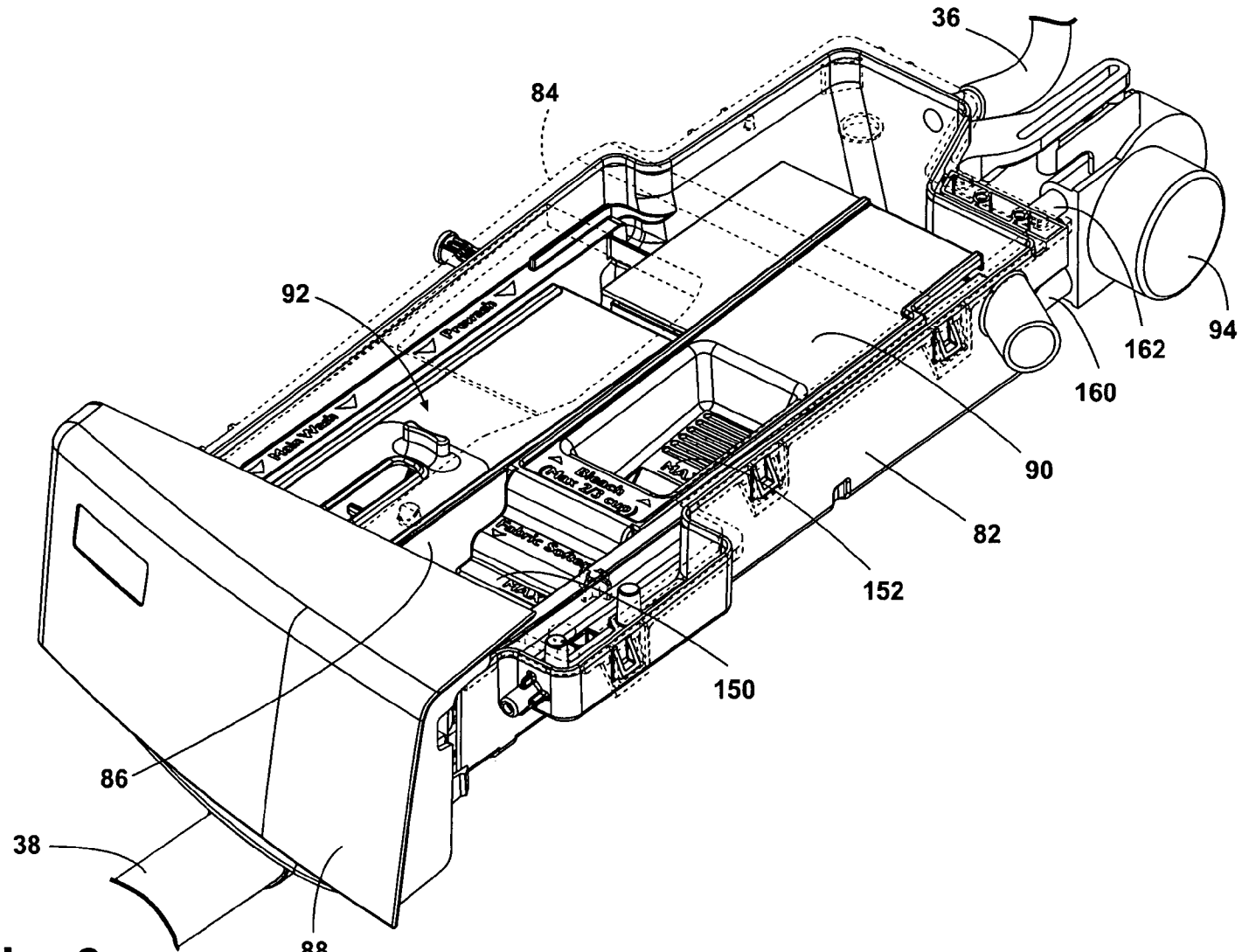
FIG. 3 is a perspective view of a second exemplary bulk dispensing system according to one embodiment of the invention having a drawer-type dispenser, which is shown in the closed position with an installed bulk dispensing cartridge.

FIG. 3 illustrates a specific implementation of a bulk dispensing system 80 according to one embodiment of the invention that includes a lower dispenser housing 82, an upper dispenser housing 84 (shown in phantom), a dispenser drawer 86, a dispenser drawer handle 88, a cup cover 90, a removable bulk dispenser cartridge 92 configured to store multiple doses of a treating chemistry, and a dispenser pump 94. The bulk dispensing system 80 may be unique in that the dispenser drawer 86 may be a manual dispensing drawer that receives the bulk dispenser cartridge 92 to form the bulk dispensing system.

The lower dispenser housing 82 may be located within the cabinet 12 and underlying some or all of the dispenser drawer 86 when the dispenser drawer 86 sits in a closed position as illustrated in FIG. 3. The upper dispenser housing 84 may be located within the cabinet 12 and overlying some or all of the dispenser drawer 86 when the dispenser drawer 86 sits in the closed position. The water supply 30 may be fluidly coupled to either of the dispenser drawer 86 or the lower dispenser housing 82 via the upper dispenser housing 84, a fluid diverter 96 (FIG. 4), dispensing line 36, and valve 32, which may be operably controlled by the controller 22. Further, either of the dispenser drawer 86 or the lower dispenser housing 82 may be fluidly coupled to the treating chamber, e.g., the tub 16, via the lower dispenser housing 82 and the conduit 38. With this configuration, water may be provided from the supply to either of the housing or the drawer to flush a treating chemistry to the treating chamber through the conduit 38. In this way, the lower dispenser housing 82 and the dispensing line 38 may be described as forming a conduit to the treating chamber.

Figure 4:
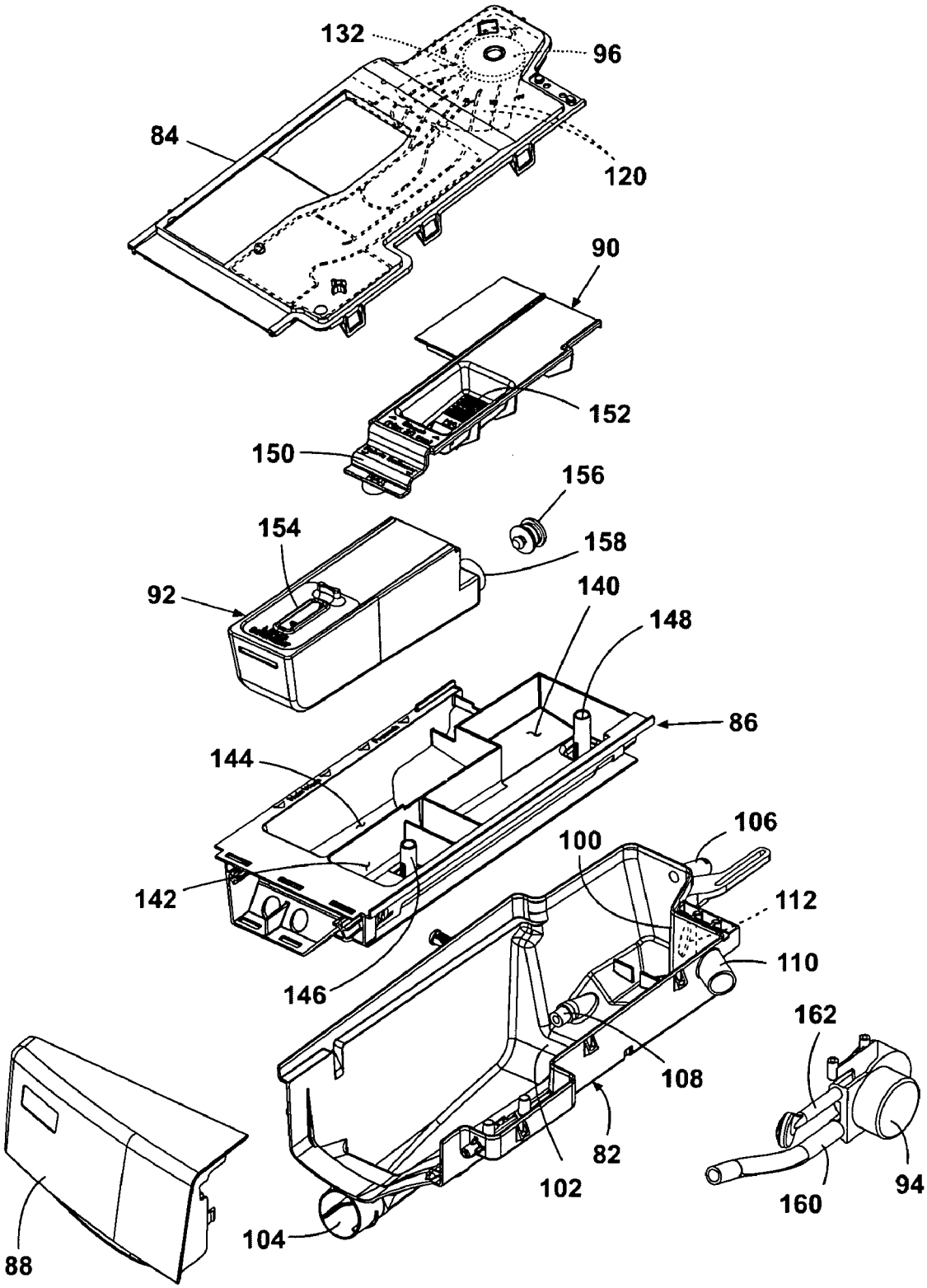
FIG. 4 is an exploded view of the bulk dispensing system illustrated in FIG. 3.

FIG. 4 illustrates an exploded view of the bulk dispensing system of FIG. 3 and better illustrates the individual components. It may be more clearly seen that the lower dispenser housing 82 may have a sloped back wall 100, a sloped bottom wall 102, and that an outlet port 104 may be located at the front of the sloped bottom wall 102. The outlet port 104 fluidly couples to the dispensing line 38, which leads to the tub 16. The lower dispenser housing 82 also may have several other ports 106, 108, 110, 112. Of these ports, port 106 may be coupled to the dispensing line 36, and functions as the primary water inlet from the water supply 30. Water entering the port 106 may be directed to the fluid diverter 96, which controls whether fluid is dispensed to the dispenser drawer 86 or directly to the lower dispenser housing 82.

The directing of the water may be accomplished by forming the upper dispenser housing 84 with internal water paths 120 located in its interior. Water from the port 106 enters the fluid diverter 96 and may be directed through the fluid diverter outlet 130 into one of the different water paths 120 to various portions of the lower dispenser housing 82 and to various portions of the dispenser drawer 86. Each of the water paths 120 may be designed to direct water to a particular area in the dispenser drawer 86 or to bypass the dispenser drawer 86. The fluid diverter 96 directs the water to the one of the water paths 120. The fluid diverter 96 may be electrically coupled with the controller 22 through a control lead 130 (FIG. 2). Thus, the fluid diverter 96, operated by the controller 22, operates to selectively control the fluid coupling of the fluid diverter outlet 132 with different water paths 120.

The dispenser drawer 86 defines at least one treatment cup, used as a treating chemistry compartment to hold treating chemistry for at least a single use of the automatic washing machine 10. The dispenser drawer may be illustrated as including multiple treatment cups 140, 142, 144 that act as treating chemistry reservoirs or compartments that may hold liquid treating chemistry, such as laundry detergent, fabric softener, bleach, and the like. Each of the cups 140, 142, 144 may have a corresponding water path 120, such that water may be selectively directed to each of the treatment cups 140, 142, 144.

Suction posts, such as posts 146, 148, may be provided in the cups to suction the water and chemistry from the cup and into the lower dispenser housing 82, where the water and chemistry will flow to the treating chamber through outlet port 104. The cup cover 90 hides suction posts 146, 148 and provides fill instructions for the user. [Note: Water may be added to the cup until the liquid is above the suction post, at which point the liquid may be drawn by gravity into the post, which initiates a siphon process for removing the liquid from the cup. Some of the cups, like cup 144, may have an opening (not shown) in the wall of the cup where the water and chemistry may flow out into the lower dispenser housing 82, where the water and chemistry will then flow to the treating chamber through outlet port 104.

With this configuration, chemistry in the cups may be dispensed by supplying a flushing volume of water to the cups using the fluid diverter 96 to flush the chemistry from the cup and into the underlying lower dispenser housing 82, where it flows to the treating chamber.

The dispenser drawer 86 may be slideably moveable between an opened position, where the at least one treatment cup may be accessible exteriorly of the cabinet 12, and a closed position, where the at least one treatment cup may be within the cabinet 12. For example, a user may pour a treating chemistry into a front portion of the cup cover 150 or a back portion of the cup cover 152 to load treatment cup 140 or 142 respectively with the treating chemistry.

The bulk dispenser cartridge 92 may be removeably received in one of the cups, such as treatment cup 144. The bulk dispenser cartridge 92 may contain a quantity of a treating chemistry, such as a laundry detergent, stored therein and sufficient for several wash cycles. The bulk dispenser cartridge 92 may store multiple doses of treating chemistry when compared to what is typically used when the cup 144 is used as a single use cup. The use of the bulk dispenser cartridge 92 may eliminate the need for a user to measure out a selected volume of treating chemistry for each wash cycle.

The bulk dispenser cartridge 92 may be illustrated as a generally rectilinear, box-like container defining a cartridge cavity in which the treating chemistry may be contained. The cartridge cavity may be accessible through an opening selectively closed by a closing element 154 operable between an open and closed position through which the bulk dispenser cartridge 92 may be filled when the closing element may be in the open position. Alternately the cartridge 92 may be a pre-filled non-refillable container.

Although the bulk dispenser cartridge has been described as a rectangular box-like container, the bulk dispensing cartridge may be any type of removable container configured to store multiple doses of a treating chemistry. The container may have any shape and size that is receivable within the dispenser. The removable container may be flexible, rigid, expandable, or collapsible. The container may be made of any type of material. Some examples of suitable cartridges are, without limitation, a plastic container, a cardboard container, a coated cardboard container, and a bladder, all of which are capable of being received within the dispenser.

A bulk dispenser pump 94 may be provided to fluidly couple with the bulk dispenser cartridge 92 to the lower dispenser housing 82. The bulk dispenser pump 94 may be mounted to the exterior of the lower dispenser housing 82. In this way, the dispenser pump 94 may pump chemistry from the bulk dispenser cartridge 92, into the lower dispenser housing 82, and the fluid diverter 96 will divert water into the lower dispenser housing 82 to flush the chemistry to the treating chamber through the outlet port 104 and line 38. The dispenser pump 94 may be operably coupled with the controller 22 such that the controller 22 may implement the cleaning cycle by controlling the operation of the dispenser pump 94 to control the dosing of the treating chemistry from the bulk dispensing cartridge 92 to the lower dispenser housing 82.

To effect the fluid coupling of the bulk dispenser with the dispenser pump 94, a coupler 156 may be provided within a port 158 of the bulk dispenser cartridge 92. When the dispenser drawer 86 lies in the closed position, port 108 may be received within the coupler 156 wherein the coupler 156 then fluidly couples the dispenser cartridge 92 with the port 108 and the dispenser pump 94. The dispenser pump 94 may be mounted to the lower bulk lower dispenser housing 82 such that a dispenser pump inlet 160 fluidly couples with the bulk dispenser cartridge 92 through the port 108 in the lower dispenser housing 82. The dispenser pump outlet 162 fluidly couples through a second port 112 in the lower dispenser housing 82 such that when treating chemistry is dispensed through the dispenser pump outlet 162 it is dispensed into the lower dispenser housing 82.

Figure 5:
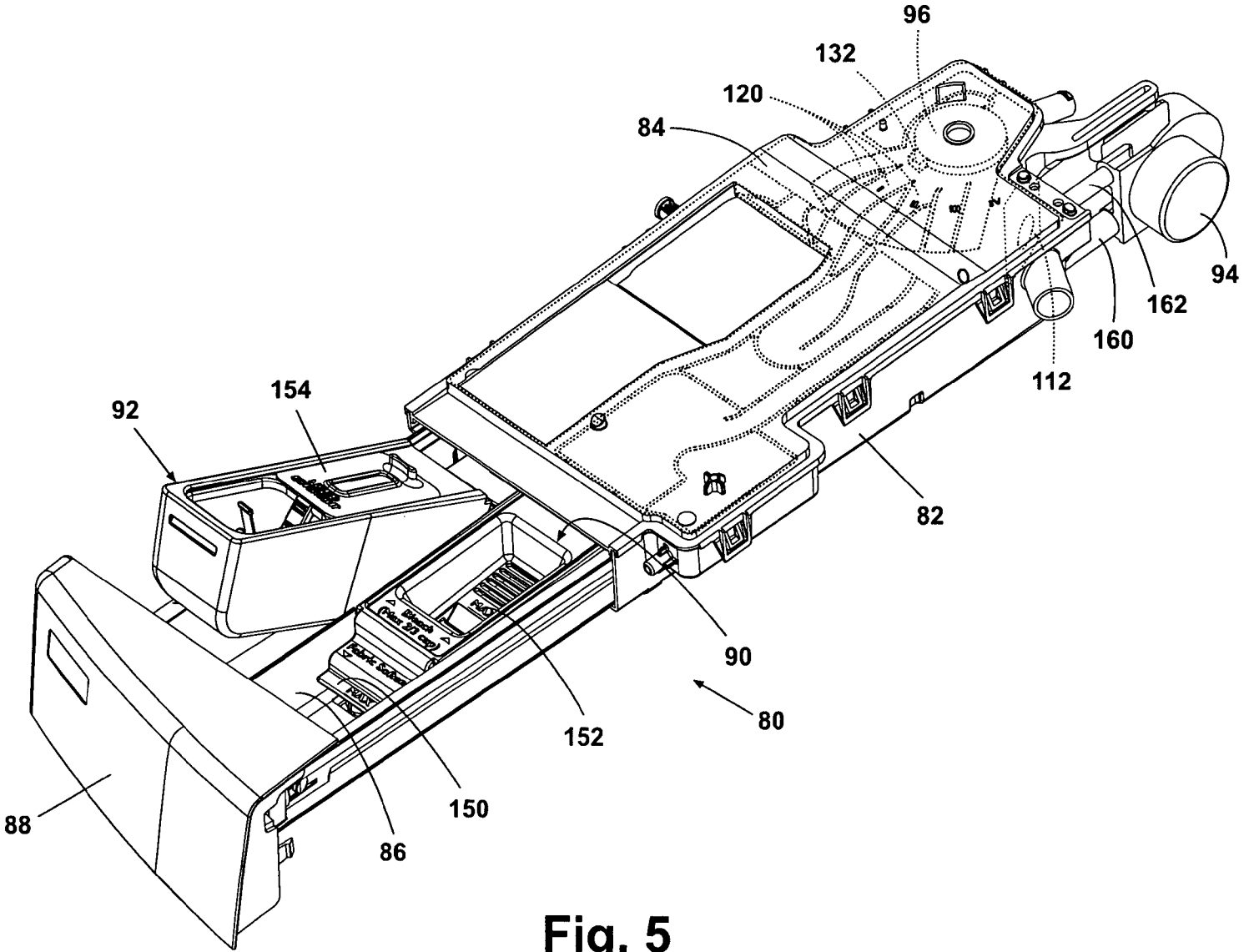
FIG. 5 is a second perspective view of the bulk dispensing system of FIG. 3 with the drawer shown in an opened position and the bulk dispensing cartridge partially inserted in the drawer.

FIG. 5 illustrates the exemplary bulk dispensing system 80 of FIGS. 3-4 wherein the dispenser drawer 86 lies in the opened position and the bulk dispenser cartridge 92 rests partially installed in the dispenser drawer 86. After the bulk dispenser cartridge 92 is installed in the dispenser drawer 86, a user or machine selected volume of treating chemistry may be dispensed from the bulk dispenser cartridge 92 through operation of the dispenser pump 94 under the control of the controller 22. Typically, this could be accomplished by a user selecting a wash cycle on the user interface 20, which would then be processed by the controller 22, along with an optional determination in a known manner of certain characteristics of the load, such as the size and/or fabric types, for example, to automatically dispense the appropriate volume of treating chemistry. Alternatively, the user selecting a volume of treating chemistry on the user interface 20 would accomplish this.

During operation of the automatic clothes washing machine 10, the bulk dispensing system 80 may be employed to dispense the treating chemistries contained therein into the treating chamber under the control of the controller 22. When time comes to dispense the treating chemistry, the controller 22 signals the dispenser pump 94 to supply a treating chemistry from the bulk dispenser cartridge 92 to the sloped back wall 100. The controller 22 then signals the valve 32 to allow water from the water supply 30 into port 106 of the lower dispenser housing 82 wherein the fluid diverter 96 directs water towards the treating chemistry located in the lower dispenser housing 82. Then, both the water and the treating chemistry travel down the sloped bottom wall 102, through the outlet port 104, through the dispensing line 38, and into the treating chamber, e.g., the tub 16. In other embodiments of the invention, after exiting the lower dispenser housing 82 the treating chemistry may also go through sprayers or additional conduits on its way to the tub 16.

A first example of operating the automatic washing machine 10 to effect a flushing of the bulk dispensing system 80 will now be described with respect to the flushing of at least a portion of the bulk dispensing system 80 when the bulk dispenser cartridge 92 is removed. The removal of the bulk dispensing cartridge 92 may be an opportune time to flush the bulk dispensing system 80 because the user may chose to insert a new cartridge containing a different chemistry or fill and reinsert the existing cartridge with a different chemistry.

Once removal of the bulk dispenser cartridge 92 from the dispenser drawer 86 takes place, the treating chemistry sensor 68 may sense the removal of the bulk dispenser cartridge 92 and output an electrical signal to the controller 22 to indicate removal of the bulk dispenser cartridge 92. In other embodiments, a variety of other techniques and devices could also be used to determine when the bulk dispenser cartridge 92 has been removed. When the signal indicates the bulk dispenser cartridge 92 has been removed from the bulk dispensing system 80 the controller 22 may be programmed to take action to flush at least a portion of the bulk dispensing system 80. For example, the controller 22 may introduce water from the water supply 30 into the lower dispenser housing 82. This may act to flush both the lower dispenser housing 82 and the conduit formed by the lower dispenser housing 82 and the dispensing line 38. The controller 22 may also introduce water from the water supply 30 into the dispenser drawer 86. This may act to flush both the dispenser drawer 86 and at least a portion of the lower dispenser housing 82 or conduit as they are fluidly coupled. The dispenser pump 94 may also be run at this time to effect a flushing of the dispenser pump 94 along with the bulk dispensing system. For example, if the dispenser pump 94 is run normally, water is drawn from the treatment cup 144 and dispensed into the lower dispenser housing 82.

As an alternative to the automatic initiation of the flushing cycle, the user may instead initiate the flushing cycle after the removal of the bulk dispenser cartridge 92. Once removal of the bulk dispenser cartridge 92 takes place, the user may initiate such an operation by operating the user interface 20 in such a manner that the user selects a flush cycle. This input commands the controller 22 to run a flush cycle similar to those described above where any portion of the bulk dispensing system 80 may be flushed including the lower dispenser housing 82, the dispenser drawer 86, the conduit, and the dispenser pump 94.

It should be noted that in the automatic clothes washing machine 10 the user initiated flush cycle may be inoperative if the bulk dispenser cartridge 92 is present in the bulk dispensing system 80. However, in the alternative, if the bulk dispenser cartridge 92 is present and the user has initiated a flush cycle a sensor (not shown) may detect whether the closing element 154 is open. If the closing element 154 is open the user initiated flush cycle may be allowed by the controller 22 and the bulk dispenser cartridge 92 may be flushed through the open closing element 154.

As an alternative to initiating the flushing upon the removal of the bulk dispenser cartridge, the flushing may be initiated upon a determination that the bulk dispenser cartridge 92 is empty. After proper installation of the bulk dispenser cartridge 92 in the dispenser drawer 86, the treating chemistry sensor 68 may be used to indicate when the bulk dispenser cartridge 92 is empty. A suitable treating chemistry sensor 68 may sense the level of treating chemistry in the bulk dispenser cartridge 92 and output an electrical signal to the controller 22 to indicate the emptiness of the bulk dispenser cartridge 92.

When the bulk dispenser cartridge 92 is empty, the controller 22 may be programmed to take action to flush at least a portion of the bulk dispensing system 80. That is, the controller 22 may introduce water from the water supply 30 into the bulk dispenser cartridge 92 (as described below) in essence flushing the bulk dispenser cartridge 92 and a portion of the bulk dispensing system 80. The dispenser pump 94 may be actuated to pump the water from the bulk dispenser cartridge 92, which also flushes the dispenser pump 94 along with the bulk dispenser cartridge 92. The water from the water supply 30 may be introduced into the open/closing element 154 of the cartridge, which may be manually opened by the user or automatically opened. The water will be directed through the fluid diverter 96 along the appropriate water path 120 to the open closing element 154.

The controller 22 may also introduce water from the water supply 30 into the dispenser drawer 86. This may act to flush both the dispenser drawer 86 and at least a portion of the lower dispenser housing 82 as the two are fluidly coupled. The controller 22 may introduce water from the water supply 30 into the lower dispenser housing 82. This may act to flush both the lower dispenser housing 82 and the conduit. The flushing of the lower dispenser housing 82 or conduit may also act to flush the dispenser pump 94, which fluidly couples the conduit.

Upon the user noticing that the bulk dispenser cartridge 92 may be empty the user may also initiate the operation of the automatic washing machine 10 to effect a flushing of at least a portion of the bulk dispensing system 80. The user may initiate such an operation by operating the user interface 20 in such a manner that the user selects a flush cycle. This inputs commands to the controller 22 about running a flush cycle similar to those described above where any portion of the bulk dispensing system 80 may be flushed including the bulk dispenser cartridge 92, the lower dispenser housing 82, the dispenser drawer 86, the conduit formed of the lower dispenser housing 82 and dispensing line 38, and the dispenser pump 94.

Alternatively, the bulk dispensing system 80 may be flushed in response to a predetermined stimulus regardless of whether the bulk dispenser cartridge 92 is present or not and regardless of whether it is empty or not. In either case, the user may override the automatic flushing for a single cleaning cycle and provide a predetermined stimulus for the flushing of the bulk dispensing system 80. In this method, the user through a separate button (not shown) on the user interface 20 may effect a flushing of a portion of the bulk dispensing system 80. In that case, the manual button may control the operation of the fluid diverter 96 in response to what type of flushing was selected by the user. The user may choose to flush the fluid paths in the bulk dispensing system 80 either before or after the location of an installed bulk dispensing cartridge 92.

When the signal indicates that the user has initiated a flushing, the controller 22 may introduce water from the water supply 30 into the lower dispenser housing 82 past the bulk dispenser cartridge 92. Thus, this user-initiated flush may take place regardless of whether a bulk dispenser cartridge 92 is present or empty. This may act to flush both the lower dispenser housing 82 and the conduit formed by the lower dispenser housing 82 and the dispensing line 38. Alternatively, the controller 22 may also introduce water from the water supply 30 into the multiple treatment cups 140, 142, and 144. This may act to flush both the dispenser drawer 86 and at least a portion of the lower dispenser housing 82 or conduit.

One benefit of a user initiated flush may be that the user is able to remove a bulk dispenser cartridge 92 that is partially full of treating chemistry and flush the bulk dispensing system. The user may then reinstall the partially full bulk dispenser cartridge 92, replace it with another bulk dispenser cartridge 92 or operate the automatic clothes washing machine 10 without a bulk dispenser cartridge 92. An additional benefit may be that the user is able to put in a cartridge that contains clean-out chemistry for aiding the flushing of the bulk dispensing system 80. Additionally, the user may also be able to pour clean-out chemistry into the bulk dispensing system 80, such as into any of the multiple treatment cups 140, 142, 144, before initiating a flush.

While the invention has been specifically described in connection with certain specific embodiments thereof, it is to be understood that this is by way of illustration and not of limitation, and the scope of the appended claims should be construed as broadly as the prior art will permit.

What is claimed is:

1. A household cleaning appliance, comprising:

a treating chamber;

a bulk dispensing system coupled with the treating chamber and configured to receive a removable cartridge containing multiple doses of a treating chemistry, the bulk dispensing system further configured to deliver a charge of treating chemistry from the cartridge to the treating chamber through a first flowpath;

a water supply configured to be selectively coupled to the bulk dispensing system;

a sensor outputting a signal indicative of a presence of the bulk dispensing cartridge in the bulk dispensing system; and a controller coupled with the water supply and sensor and configured to supply water to flush the bulk dispensing system in response to the controller determining an absence of the cartridge based on the signal from the sensor.

2. The household cleaning appliance according to claim 1, further comprising a diverter for directing water from the water supply through a second flowpath in the bulk dispensing system.

3. The household cleaning appliance according to claim 1, further comprising a valve to couple the water supply with the bulk dispensing system wherein the controller controls the valve to selectively couple the water supply to the bulk dispensing system.

4. A household cleaning appliance, comprising:

a treating chamber;

a bulk dispensing system coupled with the treating chamber and configured to receive a removable cartridge containing multiple doses of a treating chemistry, the bulk dispensing system further configured to deliver a charge of treating chemistry from the cartridge to the treating chamber through a first flowpath;

a water supply configured to be selectively coupled to the bulk dispensing system;

a sensor outputting a signal indicative of a presence of the bulk dispensing cartridge in the bulk dispensing system; and means for flushing the bulk dispensing system with water in response to an absence of the cartridge.

5. A household cleaning appliance, comprising:

a treating chamber;

a bulk dispensing system coupled with the treating chamber and configured to receive a removable cartridge containing multiple doses of a treating chemistry, the bulk dispensing system further configured to deliver a charge of treating chemistry from the cartridge to the treating chamber through a first flowpath;

a water supply configured to be selectively coupled to the bulk dispensing system;

a sensor outputting a signal indicative of an emptiness of the bulk dispensing cartridge; and a controller coupled with the water supply and sensor and configured to supply water to flush the bulk dispensing system in response to the controller determining the emptiness of the bulk dispensing cartridge based on the signal from the sensor.

6. The household cleaning appliance according to claim 5, further comprising a diverter for directing water from the water supply through a second flowpath in the bulk dispensing system.

7. The household cleaning appliance according to claim 5, further comprising a valve to couple the water supply with the bulk dispensing system wherein the controller controls the valve to selectively couple the water supply to the bulk dispensing system.

8. A household cleaning appliance, comprising:

a treating chamber;

a bulk dispensing system coupled with the treating chamber and configured to receive a removable cartridge containing multiple doses of a treating chemistry, the bulk dispensing system further configured to deliver a charge of treating chemistry from the cartridge to the treating chamber through a first flowpath;

a water supply configured to be selectively coupled to the bulk dispensing system;

a sensor outputting a signal indicative of an emptiness of the bulk dispensing cartridge; and means for flushing the bulk dispensing system with water in response to the emptiness of the bulk dispensing cartridge.

* * * * *